US007108608B2

(12) United States Patent
Field et al.

(10) Patent No.: US 7,108,608 B2
(45) Date of Patent: Sep. 19, 2006

(54) INFLATABLE BOUNCER

(75) Inventors: Robert Field, Lakeville, MN (US); Brian Field, Inver Grove Heights, MN (US)

(73) Assignee: Cutting Edge Creations, Eagan, MN (US)

( * ) Notice: Subject to any disclaimer, the term of this patent is extended or adjusted under 35 U.S.C. 154(b) by 0 days.

(21) Appl. No.: 10/698,000

(22) Filed: Oct. 30, 2003

(65) Prior Publication Data

US 2005/0107174 A1 May 19, 2005

(51) Int. Cl.
*A61G 31/00* (2006.01)

(52) U.S. Cl. ..... 472/134; 52/2.11; 482/27

(58) Field of Classification Search ..... 472/134; 52/2.11, 2.17, 2.18, 2.21, 2.22, 2.24; 446/220, 446/221, 223, 225, 226; 482/27–29, 26
See application file for complete search history.

(56) References Cited

U.S. PATENT DOCUMENTS 2,875,771 A * 3/1959 Brewin ..... 52/2.11
2,946,337 A * 7/1960 Wolshin ..... 52/2.21
4,295,302 A * 10/1981 Liu ..... 52/2.21
5,226,261 A * 7/1993 Wilbourn et al. ..... 52/2.21
5,247,768 A * 9/1993 Russo ..... 52/2.13
5,462,505 A * 10/1995 Blair et al. ..... 482/27
5,471,797 A * 12/1995 Murphy ..... 52/2.17
5,555,679 A * 9/1996 Scherba ..... 52/2.18
5,570,544 A * 11/1996 Hale et al. ..... 52/2.18
5,678,357 A * 10/1997 Rubio et al. ..... 52/2.17
5,772,535 A * 6/1998 Murphy ..... 473/415
5,893,238 A * 4/1999 Peacock et al. ..... 52/2.18
5,987,822 A * 11/1999 McNiff et al. ..... 52/2.11
6,029,404 A * 2/2000 Lewis ..... 52/2.18
6,565,405 B1 * 5/2003 Hsu et al. ..... 446/89
6,679,811 B1 * 1/2004 Chen ..... 482/29
6,722,084 B1 * 4/2004 Berman ..... 52/2.11

* cited by examiner

*Primary Examiner*—Kien Nguyen
(74) *Attorney, Agent, or Firm*—Schwegman, Lundberg, Woessner & Kluth, P.A.

(57) ABSTRACT

An inflatable bouncer includes an inflatable bottom section, an inflatable inner column coupled to a center of the bottom section, and a plurality of inflatable columns around a periphery of the bottom section. An uninflated roof extends between the inner column and the outer columns.

7 Claims, 4 Drawing Sheets

INFLATABLE BOUNCER

FIELD

This invention relates to the field of inflatables, and more specifically to inflatable bouncers.

BACKGROUND

Inflatables, such as inflatable bouncers, are air-inflated devices that are typically used for children's amusement as well as advertising purposes. Inflatables have been designed to resemble real-life objects, such as ships, fire trucks, and animals. Inflatable bouncers include a bottom, inflated bouncing section. Some bouncers include a roof. However, when designing such bouncers to look like a real-life object, present designs do not provide for a realistic appearance in all cases. What is needed is an inflatable bouncer structure allowing for a roofed-type bouncer having a realistic appearance.

SUMMARY

An apparatus comprising an inflatable bouncer having an uninflated roof with a central portion and a periphery, wherein the uninflated roof is supported in its center portion by an inflated column.

DETAILED DESCRIPTION

The following detailed description and accompanying drawings show various embodiments according to the inventive subject matter disclosed herein. These embodiments are described in sufficient detail to enable those skilled in the art to practice the invention. Other embodiments may be utilized and structural changes may be made without departing from the scope of the present invention.

Figure 1:
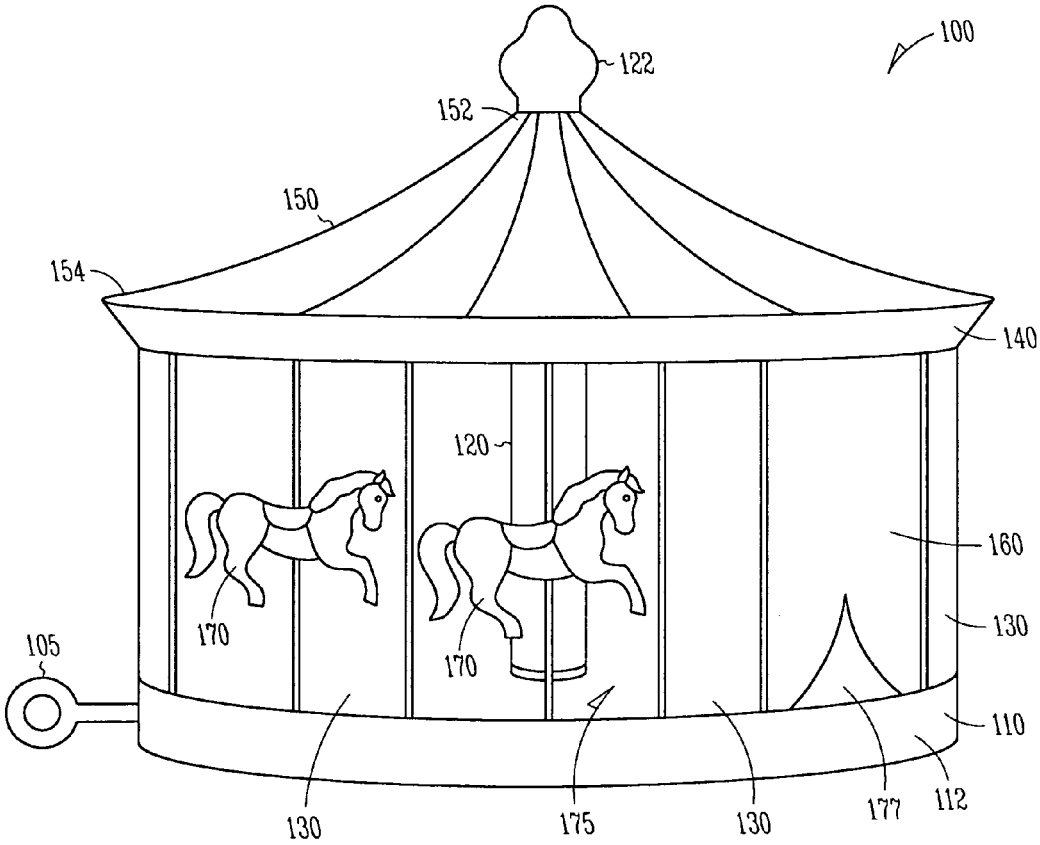
FIG. 1 shows an inflatable bouncer according to one embodiment of the inventive subject matter disclosed herein.
Figure 2:
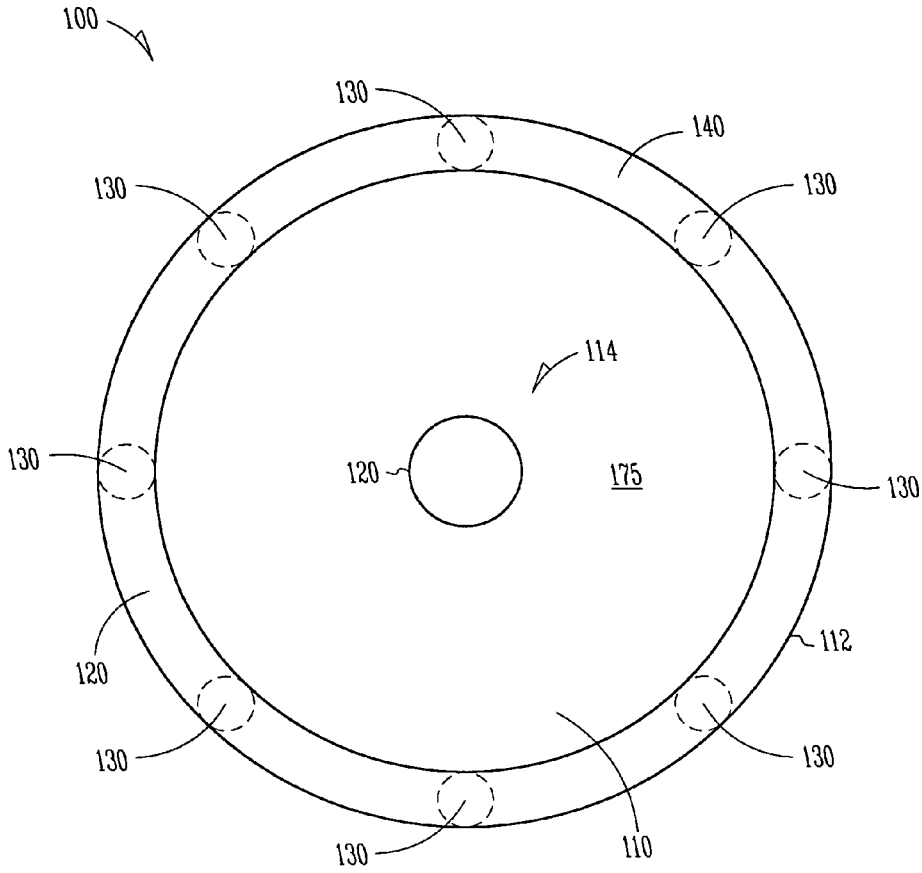
FIG. 2 shows a top view of the inflatable bouncer of FIG. 1.
Figure 3:
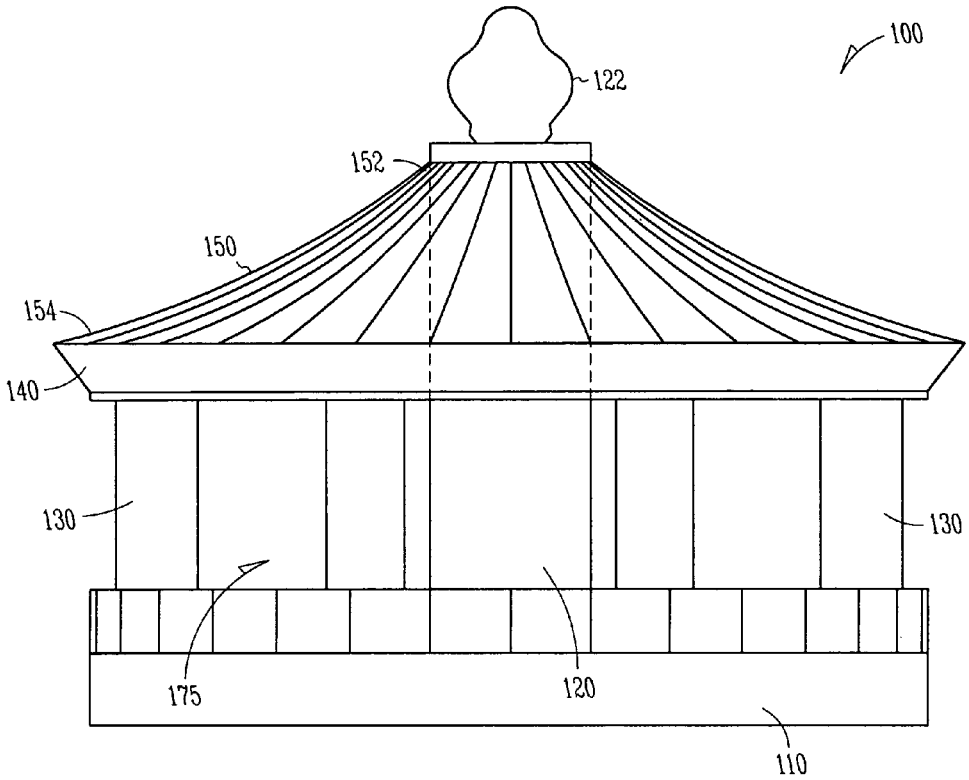
FIG. 3 shows a side view of the inflatable bouncer of FIG. 1.

FIGS. 1–3 show a perspective view, top view, and side view, respectively, of a bouncer 100 according to one embodiment of the inventive subject matter disclosed herein. Bouncer 100 includes an inflatable bottom section 110, an inflatable inner column 120, a plurality of inflatable outer columns 130, an upper inflatable support 140, and a roof 150. Bouncer 100 is used for children or adults to bounce and play inside, for instance at fairs, carnivals, or other events. In this example, bouncer 100 is designed to look like a carousel. A blower 105 is coupled to the bouncer to keep the bouncer inflated. Blower 105 can be a high output blower, for example.

Referring to FIG. 2, a top view of bouncer 100 is shown without the roof. Inflatable bottom section 110 can be a circular, round, inflated section made of vinyl, for example. In this example, bottom section 110 is about 3 feet high and has a diameter of approximately 25 feet. The height and diameter can vary to any desired sized. Various embodiments have a diameter of approximately 15 feet to approximately 30 feet. Bottom section includes a periphery 112 and a central area 114.

Inner column 120 is attached to and extends upward from bottom section 110. In this example, inner column 120 is in the center of bottom section 110. However, in some embodiments, the inner column is anywhere within the central area 114 of the bottom section. In some embodiments, two or more inner columns are located in the central area 114. Inner column 120 is inflatable and can be made of the same material as the bottom section. In this example, inner column 120 is approximately 20 feet high and includes a knob 122 at its peak designed to look like the top of a carousel.

Outer columns 130 are coupled to bottom section 110 around the periphery of the bottom section. Each of the outer columns is inflatable and made of the same material as the bottom section. In one embodiment, eight outer columns are used and positioned equidistant from each other around the periphery of the bottom section. The outer columns are shorter than the inner column. In one embodiment, the outer columns are approximately 10–15 feet high.

Upper inflatable support 140 is an inflatable section attached to the top of outer columns 130. In this example, upper support 140 has approximately the same diameter as bottom section 110.

Each of bottom section 110, inner column 120, outer columns 130, and support 140 are connected together so that the interiors of the members communicate with each other so that air blown into the bouncer through the bottom section inflates each other section.

Roof 150 is an uninflated flexible sheet of material coupled at its inner portion 152 to inner column 120 and at its periphery or outer portion 154 to either upper support 140 or to the tops of columns 130. In this example, to allow bouncer 100 to better resemble a carousel, roof 150 is attached to inner column 120 below knob 122 and the roof then hangs or drapes down and the outer portion 154 is attached to the upper support 140. This unsupported-by-air, uninflated appearance of roof 150 gives bouncer 100 the appearance of a carousel. In some embodiments, upper section 140 can be omitted and roof 150 is coupled to the tops of each of outer columns 130.

In one embodiment, bouncer 100 includes a mesh wall 160 extending around the outside of the bouncer and extending between bottom section 110 and section 140. A plurality of animal silhouettes 170 are attached to mesh wall 160 at locations around the bouncer. In one embodiment, silhouettes 170 are digitally printed vinyl sheets which can be printed to depict the decorations and colors of typical carousel animals. In one embodiment, the printed vinyl silhouettes can be cut to look like horse silhouettes, for example.

An inner play area 175 of bouncer 100 is accessible through a door 177 in mesh wall 160. The inner area 175 is uninflated. The only portions of bouncer 100 that are inflated by blower 105 are the bottom section 110, the inner column 120, the outer columns 130, and upper section 140.

In various embodiments, the bouncer can be oval, rectangular, or other shapes, depending on the design the designer is trying to capture.

Figure 4:
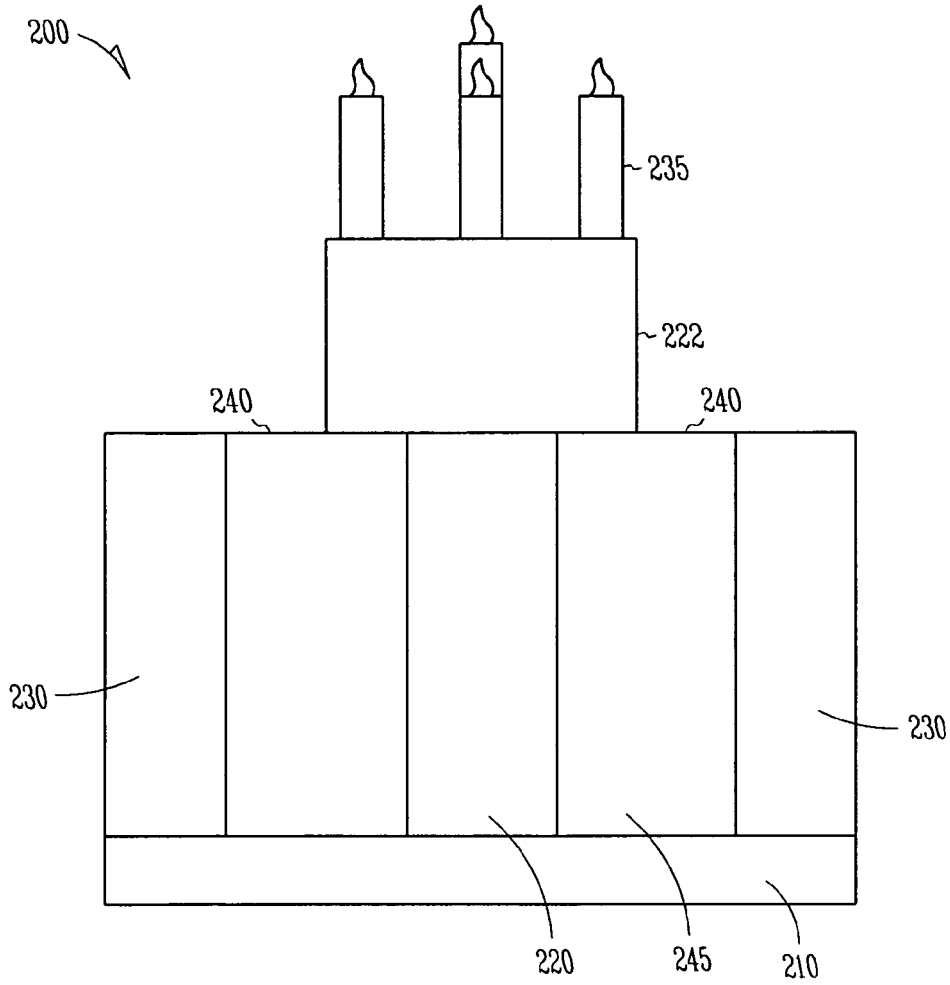
FIG. 4 shows a side view of an inflatable bouncer according to one embodiment of the inventive subject matter disclosed herein.

FIG. 4 shows a side view of an inflatable bouncer 200 in accordance with one embodiment of the inventive subject matter disclosed herein. Bouncer 200 is designed to resemble a cake. Bouncer 200 includes an inflatable bottom section 210, an inflatable inner column 220 coupled proximate the central area of bottom section 210, one or more inflatable outer columns 230 around the periphery of the bottom section, and an uninflated roof 240 coupled to and extending generally horizontally between inner column 220 and outer columns 230.

In one embodiment, one or more candle figures 235 can extend from the top of inner column 220. An upper portion 222 of inner column 220 can have an enlarged diameter to provide for a tiered look for bouncer 200. Bottom section 210 can be round, oval, square or other desired shape. A mesh wall 245 can extend around the outer area of the bouncer.

The structure of bouncer 200 allows for the realistic appearance of a cake by utilizing inflated inner column 220 to support the uninflated roof 240. Other bouncers can be designed utilizing such a structure as shown for the carousel of bouncer 100 and the cake of bouncer 200.

According to one method of the inventive subject matter disclosed herein, there is provided a technique to support the roof of an inflatable to provide a more realistic looking design. One embodiment includes supporting an uninflated roof with a center portion and a periphery, wherein the roof is supported in the center portion by an inflated column. This allows the roof to naturally hang down and provide the desired look for the inflatable structure. In some examples the roof can be extended between the central inflated column and a plurality of outer inflated columns.

The above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. An inflatable device comprising:

a circular, inflatable bottom section having a periphery and a central area;

an inflatable inner column coupled to the bottom section proximate the central area and extending upward to a peak;

a plurality of inflatable, outer columns coupled proximate the periphery;

an upper support section coupled to a top of each of the outer columns;

a wall extending between the bottom section and the upper support section and having a door; and an uninflated roof attached to the inner column at a location below the peak and supported by the inner column and the upper support section such that the inflatable bouncer has the appearance of a carousel.

2. The inflatable device of claim 1, further including silhouettes of animals on the mesh wall.

3. The inflatable device of claim 1, wherein the inner column is attached at a center of the bottom section.

4. The inflatable device of claim 1, wherein the wall includes a mesh wall.

5. The inflatable device of claim 1, wherein the inner column is taller than the each of the outer columns.

6. An inflatable bouncer comprising:

an inflatable bottom section having a periphery and a central area;

an inflatable inner column coupled to the bottom section proximate the central area;

a plurality of inflatable, outer columns coupled proximate the periphery; and an uninflated roof attached to the inner column and extending generally horizontally between the inner column and the outer columns such that the inflatable bouncer has the appearance of a cake, wherein a top portion of the inflatable inner column includes one or more candle figures.

7. The inflatable bouncer of claim 6, including a wall extending between the roof and the bottom section.

* * * * *